US011384627B2

(12) United States Patent
Burky et al.

(10) Patent No.: US 11,384,627 B2
(45) Date of Patent: Jul. 12, 2022

(54) SYSTEM AND METHOD FOR FIRING A CHARGE IN A WELL TOOL

(71) Applicant: Halliburton Energy Services, Inc., Houston, TX (US)

(72) Inventors: Thomas E. Burky, Mansfield, TX (US); Justin L. Mason, Denton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/251,433

(22) PCT Filed: Aug. 7, 2018

(86) PCT No.: PCT/US2018/045652

§ 371 (c)(1),
(2) Date: Dec. 11, 2020

(87) PCT Pub. No.: WO2020/032936

PCT Pub. Date: Feb. 13, 2020

(65) Prior Publication Data

US 2021/0131237 A1 May 6, 2021

(51) Int. Cl.
*E21B 43/1185* (2006.01)

(52) U.S. Cl.
CPC ..... *E21B 43/11852* (2013.01)

(58) Field of Classification Search
CPC .. E21B 43/1185; E21B 43/11852; F42D 1/04; F42B 3/22
See application file for complete search history.

(56) References Cited

U.S. PATENT DOCUMENTS 4,011,815 A * 3/1977 Garcia ..... E21B 43/117 175/4.51
4,441,427 A 4/1984 Barrett
4,616,566 A 10/1986 Yates
(Continued)

OTHER PUBLICATIONS

International Search Report and Written Opinion dated May 1, 2019 for PCT Application No. PCT/US2018/045652, filed Aug. 7, 2018 (13 pgs.).

(Continued)

*Primary Examiner* — Shane Bomar
(74) *Attorney, Agent, or Firm* — K&L Gates LLP

(57) ABSTRACT

A system for initiating a charge downhole in a wellbore includes a first donor charge detonable to produce a first detonation wave, a second donor charge detonable to produce a second detonation wave, and an acceptor charge detonable by either the first detonation wave or the second detonation wave. The system also includes a donor charge barrier separating the first donor charge from the second donor charge. The donor charge barrier includes heat dissipative and conduction characteristics for preventing deflagration from spreading between the first donor charge and the second donor charge. The system also includes an acceptor charge barrier separating the acceptor charge from the first donor charge and the second donor charge. The acceptor charge barrier includes Shockwave impedance characteristics for conveying the first detonation wave or the second detonation wave to the acceptor charge to detonate the acceptor charge.

20 Claims, 4 Drawing Sheets

(56) References Cited

U.S. PATENT DOCUMENTS

| | | | | | |
|---|---|---|---|---|---|
| 4,632,034 | A * | 12/1986 | Colle, Jr. | E21B 43/116 | 102/312 |
| 4,836,109 | A | 6/1989 | Wesson | | |
| 4,920,883 | A | 5/1990 | Barker | | |
| 4,998,477 | A * | 3/1991 | Barker | F42D 1/04 | 102/202.5 |
| 5,007,344 | A | 4/1991 | Rides | | |
| 5,088,413 | A * | 2/1992 | Huber | F42B 3/124 | 102/200 |
| 5,159,145 | A | 10/1992 | Carisella | | |
| 5,551,520 | A | 9/1996 | Bethel | | |
| 8,596,378 | B2 * | 12/2013 | Mason | E21B 43/118 | 175/4.51 |
| 8,622,149 | B2 | 1/2014 | Gill | | |
| 2004/0206503 | A1 | 10/2004 | Bell | | |
| 2010/0012321 | A1 | 1/2010 | Henderson et al. | | |
| 2015/0285040 | A1 | 10/2015 | Morrison | | |
| 2015/0323294 | A1 * | 11/2015 | Scheid | F42B 1/036 | 102/307 |

OTHER PUBLICATIONS

Dual Top Firing Head, Hunting-Titan Co flyer. This product flyer advertises the a firing head with a dual firing mechanism. This product is essentially identical to Halliburton's MDFH and thus teaches the use of direct contact to transfer detonation between components.

* cited by examiner

SYSTEM AND METHOD FOR FIRING A CHARGE IN A WELL TOOL

BACKGROUND

This section is intended to provide relevant background information to facilitate a better understanding of the various aspects of the described embodiments. Accordingly, it should be understood that these statements are to be read in this light and not as admissions of prior art.

Downhole tools may utilize charges (e.g., explosive charges) in the course of an operation within a wellbore. In some instances, a misfire may cause a firing system to not cause detonation. Thus, firing systems may include a primary firing system and a backup firing system. It is desirable to improve the efficiency of these firing systems.

BRIEF DESCRIPTION OF THE DRAWINGS

Embodiments of the system and method for firing a charge in a well tool are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure provides systems and methods for firing a charge within a wellbore. For example, the systems and methods may include a physical barrier to isolate one or more donor charges from an acceptor charge. Thus, detonation transfers from the one or more donor charges via a shockwave that propagates through the physical barrier rather than direct contact. Further, the systems and methods may include another physical barrier between the donor charges to prevent propagation of shockwaves between the donor charges.

Figure 1:
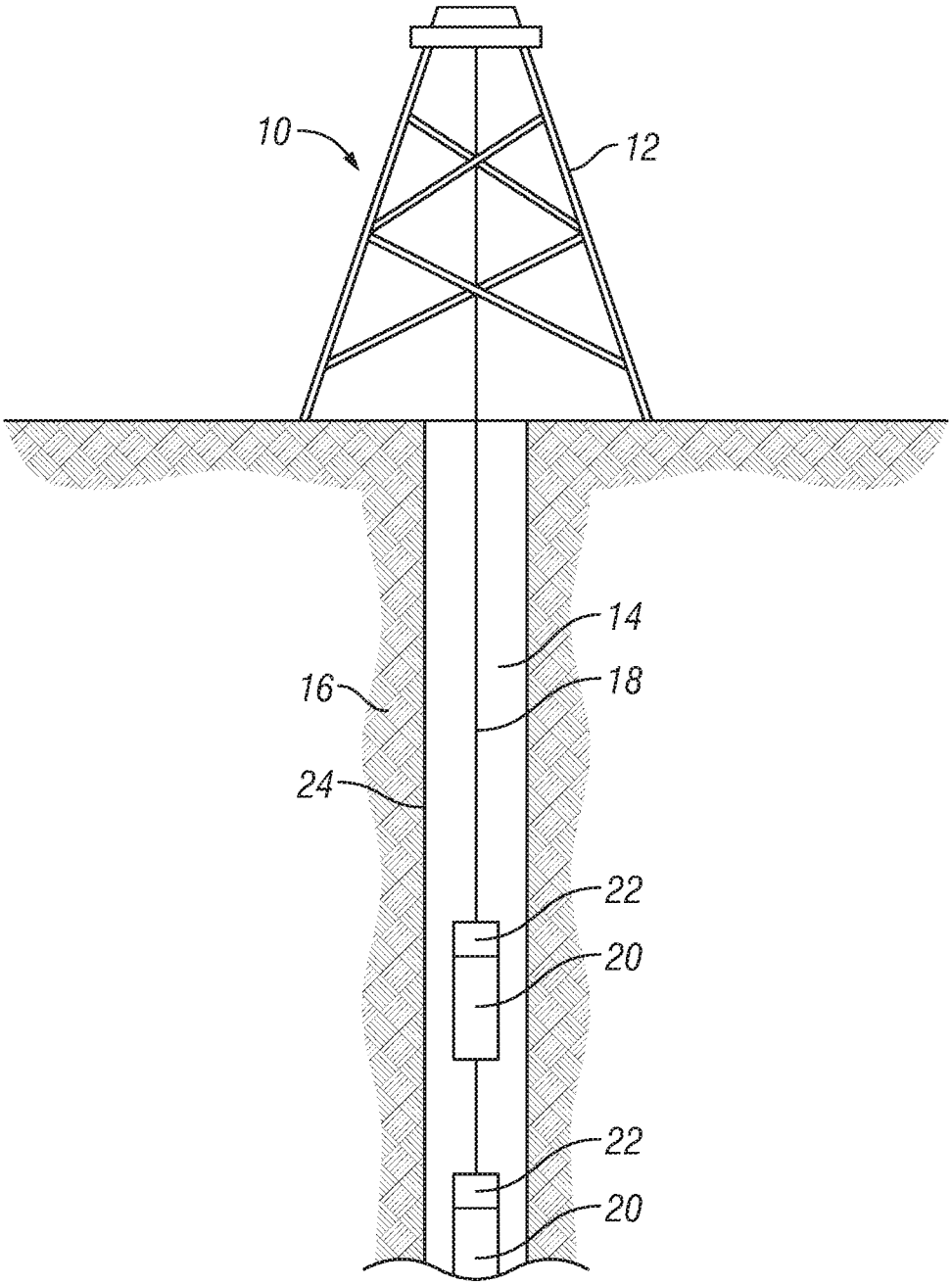
FIG. 1 is a tool system positioned within a wellbore, according to one or more embodiments.

FIG. 1 is a wellbore system 10 that includes a rig 12 that is positioned over a wellbore 14 that extends into a formation 16. The wellbore 14 is an opening in the formation 16, and the wellbore 14 may include a casing or a lining or the wellbore 14 may be an open hole. The wellbore 14 may be utilized to extract fluids or store fluids, such as hydrocarbons or water. Further, while the wellbore 14 is shown as extending vertically into the formation 16, the wellbore 14, or portions of the wellbore 14, may extend horizontally or at any angle between vertical and horizontal.

The rig 12 is utilized to aid in operations that include the use of the wellbore 14. For example, the rig 12 may include a drilling rig, a completion rig, a workover rig, or a servicing rig. The rig 12 supports the wireline 18, which conveys one or more downhole tools 20 into the wellbore 14. In some embodiments, the rig 12 may support a slickline unit, a tubular string, a hoisting apparatus, a servicing vehicle, or a coiled tubing unit. Further, the wellbore system 10 may be positioned at an offshore location. For example, the rig 12 may be supported by piers extending into the seabed or by a floating structure.

The downhole tool 20 includes a firing system 22 that activates one or more components of the downhole tool 20. The firing system 22 activates a charge, such as an explosive charge, within the downhole tool 20. As described in detail below, the firing system 22 utilizes a physical barrier and a shockwave to activate the charge within the downhole tool 20. Each downhole tool 20 may include a corresponding firing system 22, or one firing system 22 may be utilized to activate multiple downhole tools 20. In one example, the downhole tool 20 includes a perforating tool, which includes one or more explosive charges to perforate a casing to enable extraction of fluids from the formation 16 through the wellbore.

Figure 2:
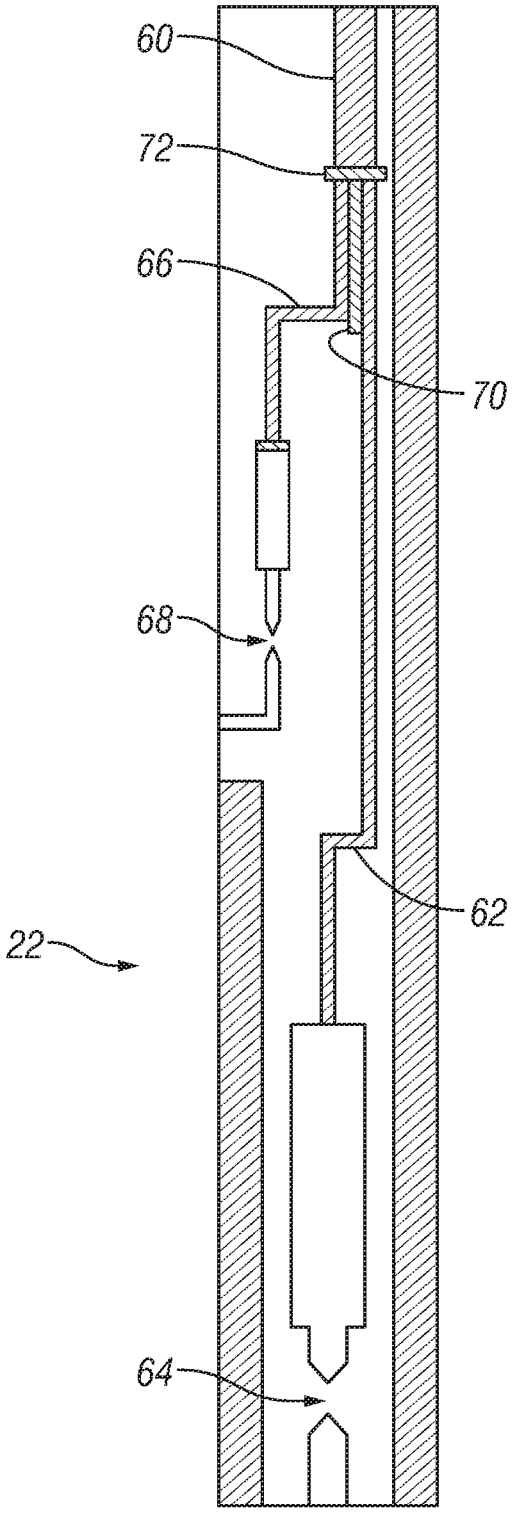
FIG. 2 is a firing system with two charges, according to one or more embodiments.

FIG. 2 illustrates a cross-sectional view of the firing system 22 of FIG. 1 to actuate an acceptor charge 60. The firing system 22 includes a first donor charge 62, which is actuated by a first firing pin 64, and a second donor charge 66, which is actuated by a second firing pin 68. The firing system also includes a donor charge barrier 70 positioned between the first donor charge 62 and the second donor charge 66 and an acceptor charge barrier 72 positioned between the donor charges 62, 66 and the acceptor charge 60. As such, the donor charge barrier 70 and the acceptor charge barrier 72 prevent direct contact between adjacent charges. As used herein, direct contact means either physical contact between two elements or contact between a flame produced by one element contacting another element.

The firing system 22 may be positioned within a tubing string, which may have a fluid-tight interior such that a fluid within the interior of the tubing string may be pressurized. Both of the first firing pin 64 and the second firing pin 68 are hydraulically actuated. For example, the first and second firing pins 64, 68 may be hydraulically coupled to the interior of the tubing string. Once a threshold pressure is achieved in the tubing string, the pressure is communicated to the first and second firing pins 64, 68, thereby causing the first and second firing pins 64, 68 to actuate. Further, the threshold pressure that causes actuation of the first and second firing pins 64, 68 may be different for each of the first and second firing pins 64, 68. For example, the threshold pressure that causes actuation of first firing pin 64 may be higher or lower than the threshold pressure that causes actuation of the second firing pin 68. In addition, the first and second firing pins 64, 68 may be actuated by other types of actuation such as electrically, mechanically, or pneumatically. Further, the first and second firing pins 64, 68 may each be actuated by different types of actuation. For example, the first firing pin 64 may be actuated by a first type of actuation and the second firing pin 68 may be actuated by a second, different type of actuation.

Actuation of the first or second firing pin 64, 68 causes actuation of the respective one of the first and second donor charges 62, 66 via heat and/or pressure created by actuation of the first or second firing pin 64, 68. Actuation of the first or second donor charge 62, 66 is the detonation of the first or second donor charge 62, 66. Thus, the detonation of the first or second donor charge 62, 66 begins at the respective firing pin and travels toward the acceptor charge 60. The acceptor charge barrier 72 is positioned between the first and second donor charges 62, 66 and the acceptor charge 60 to prevent direct contact between the first and second donor charges 62, 66 and the acceptor charge 60. Thus, the shockwave produced by the detonation of the first or second donor charge 62, 66 then propagates through the acceptor charge barrier 72 and detonates the acceptor charge 60.

Further, the donor charge barrier 70 is positioned between the first donor charge 62 and the second donor charge 66, which prevents direct contact between the first donor charge 62 and the second donor charge 66. The donor charge barrier 70 also prevents propagation of shockwaves passing between the first and second donor charges 62, 66. Thus, the donor charge barrier 70 prevents the first and second donor charges from detonating each other.

Figure 3:
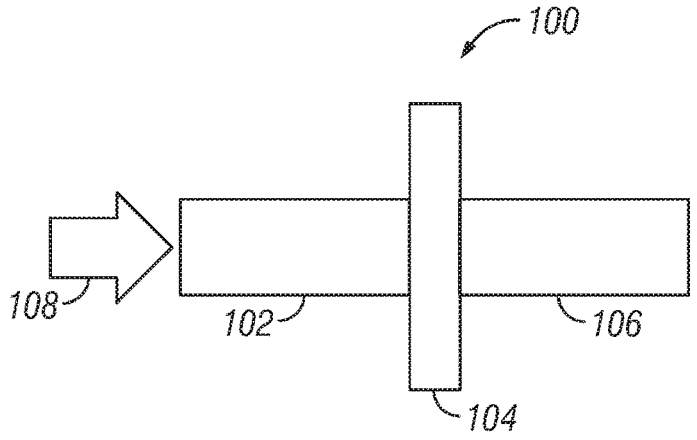
FIG. 3 is a firing system with a donor charge, an acceptor charge barrier, and an acceptor charge, according to one or more embodiments.

FIG. 3 illustrates a schematic view of a firing system 100 that includes a donor charge 102, a barrier 104, and an acceptor charge 106. The barrier 104 prevents direct contact between the donor charge 102 and the acceptor charge 106. Further, the barrier 104 enables the donor charge 102 to detonate the acceptor charge 106. For example, the donor charge 102 may produce a shockwave that propagates through the barrier 104 and into the acceptor charge 106, thereby detonating the acceptor charge 106.

As described above, the donor charge 102 is detonated by a firing pin. Then, the detonation of the donor charge 102 travels along a direction of detonation 108 toward the acceptor charge 106. The detonation of the donor charge 106 ends at the barrier 104, thereby causing a shockwave to propagate through the barrier 104. The shockwave propagates through the barrier 104 and into the acceptor charge 106, which then detonates the acceptor charge 106. Thus, by utilizing the barrier 104, the donor charge 102 may detonate the acceptor charge 106 without direct contact.

Figure 4:
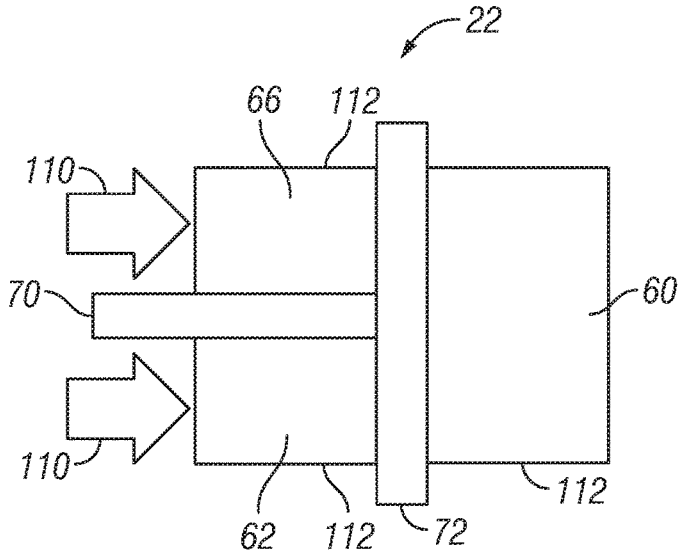
FIG. 4 is a firing system with multiple donor charges, an acceptor charge, an acceptor charge barrier, and a donor charge barrier, according to one or more embodiments.

FIG. 4 illustrates a schematic view of the firing system 22 of FIG. 2. The firing system 22 includes the first donor charge 62 and the second donor charge 66 to detonate the acceptor charge 60. The first donor charge 62 and the second donor charge 66 make the firing system 22 a dual firing system, which provides two donor charges that are each capable of detonating the acceptor charge 60. As such, the first donor charge 62 may be a primary donor charge and the second donor charge 66 may be a secondary donor charge. The primary donor charge may be detonated before the secondary donor charge, then the secondary donor charge may be detonated. Also, either donor charge may be made to be the primary donor charge.

Further, the firing system 22 includes the donor charge barrier 70 that prevents direct contact between the first and second donor charges 62, 66. The donor charge barrier 70 may isolate (e.g., hermetically seal) the first donor charge 62 from the second donor charge 66. In isolating the donor charges 62, 66 from each other, the donor charge barrier 70 prevents the donor charges 62, 66 from detonating each other. As such, the material chosen for the donor charge barrier 70 may be chosen based upon its heat conduction and impedance characteristics for preventing deflagration from spreading between the first and second donor charges 62, 66. Deflagration is the detonation and/or combustion of one of the charges. For example, stainless steel may be chosen for the donor charge barrier 70 to reduce the conduction of heat between the first and second donor charges 62, 66.

The acceptor charge barrier 72 that prevents direct contact between the two donor charges 62, 66 and the acceptor charge 60. The acceptor charge barrier 72 may isolate (e.g., hermetically seal) the acceptor charge 60 from the two donor charges 62, 66. Once the detonation of the donor charges 62, 66 travels along a direction of detonation 110 and into the acceptor charge barrier 72, a shockwave produced by the detonation propagates though the acceptor charge barrier 72 and into the acceptor charge 60, thereby detonating the acceptor charge 60. As such, the material chosen for the acceptor charge barrier 72 may be chosen based upon its heat conduction and impedance characteristics. For example, aluminum or stainless steel may be chosen for the acceptor charge barrier 72 to enhance the impedance of the shockwave propagating through the acceptor charge barrier 72. Further, the donor charge barrier 70 and the acceptor charge barrier 72 may be considered bulkheads that allow propagation of shockwaves but prevent propagation of other forms of energy, such as a flame.

In addition each of the donor charges 62, 66 and the acceptor charge 60 may be separately housed within a respective explosive container 112. Each of the explosive containers 112 may partially or fully enclose the respective one of the first donor charge 62, the second donor charge 66, or the acceptor charge 60. For example, the explosive containers 112 may surround at least a portion of longitudinal sides of the first donor charge 62, the second donor charge 66, and/or the acceptor charge 60. The explosive containers 112 may be utilized to physically contain the material that makes up the charges, and/or the explosive containers 112 may enhance the impedance characteristics of the charges. For example, the explosive containers may include brass to enhance (e.g., increase) the pressure of the shockwave produced by each charge.

Figure 5:
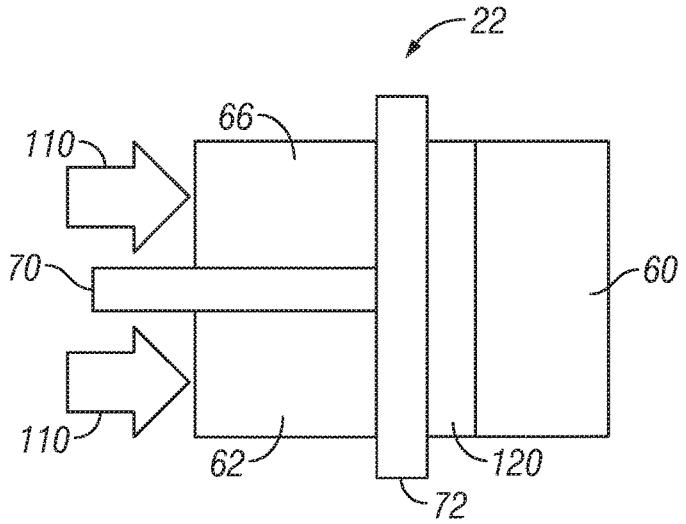
FIG. 5 is a firing system with multiple donor charges, an acceptor charge with a lower density zone, according to one or more embodiments.

FIG. 5 illustrates the firing system 22 in which the acceptor charge 60 includes a lower density zone 120, which is positioned proximate to the acceptor charge barrier 72. The lower density zone 120 is composed of the same material as the rest of the acceptor charge 60, but the density of the lower density zone 120 is lower than the density of other portions of the acceptor charge 60 by 5 percent to 25 percent, 10 percent to 20 percent, 12 percent to 18 percent, or 14 percent to 16 percent. The lower density of the lower density zone 120 enhances the sensitivity to shock of the acceptor charge 60, which also increases the likelihood that the shockwave produced by the donor charge 62, 66 will detonate the acceptor charge 60. Further, the lower density zone 120 detonates at a lower threshold pressure produced by the shockwave than the other portions of the acceptor charge 60 that have a higher density.

Figure 6:
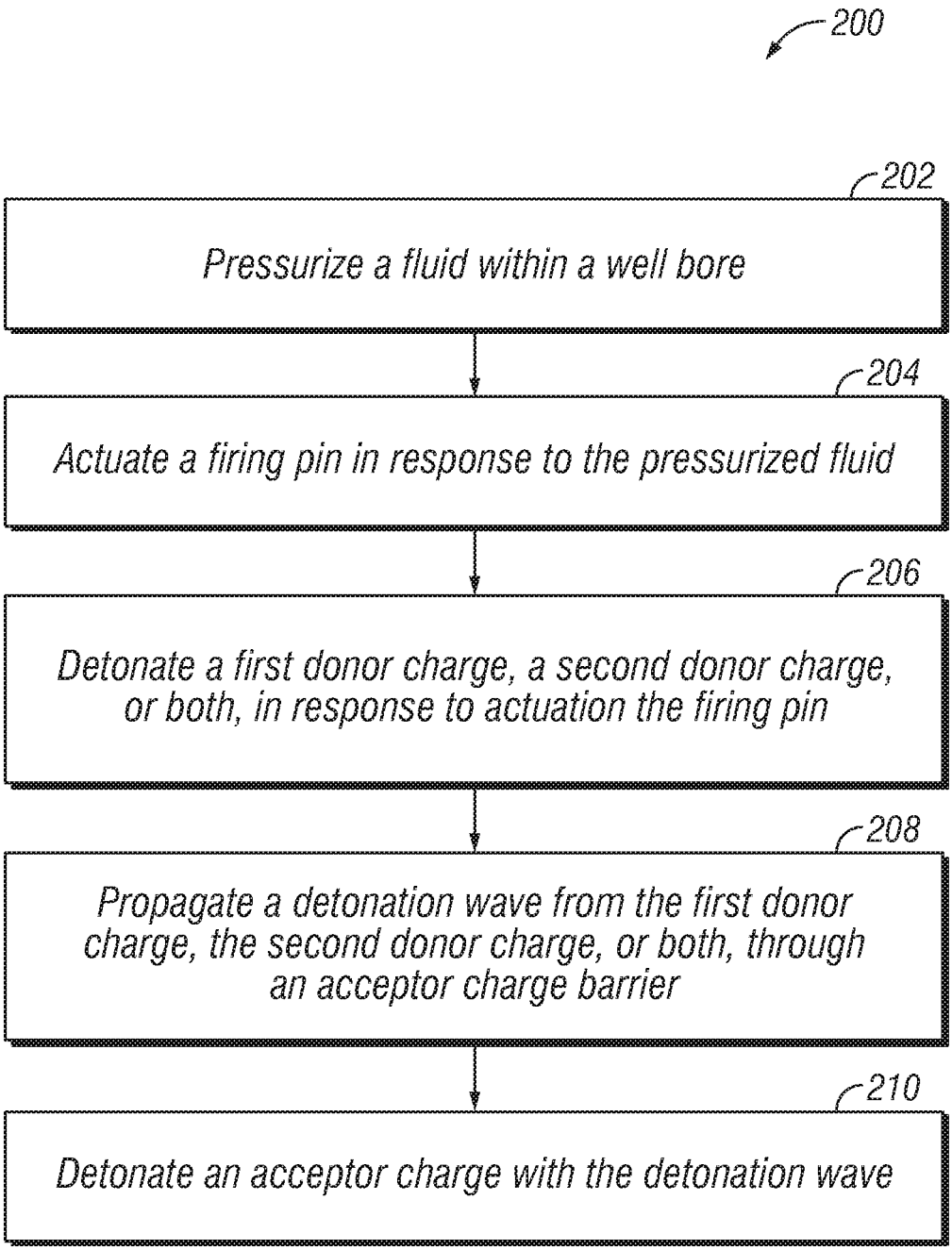
FIG. 6 is a flow chart for operation of a firing system, according to one or more embodiments.

FIG. 6 illustrates a flowchart 200 for operating one or more of the firing systems described above. For example, in embodiments in which the firing system is part of a perforating gun, the flowchart 200 may be utilized to fire the perforating gun within a wellbore. As described above, firing pins included within the firing system may be hydraulically actuated. In such embodiments, a fluid within the wellbore is pressurized in step 202. The fluid may be pressurized via pumps positioned at the surface or within the wellbore. Further, the fluid may be pressurized with a tubing string positioned within the wellbore.

Pressurization of the fluid above a threshold value then actuates a firing pin in step 204. As described above, multiple firing pins may be included within the firing system. The multiple firing pins may be actuated at the same or different pressure values. In embodiments in which the multiple firing pins are actuated at different pressure values, the fluid may be pressurized to a first threshold value to activate a first firing pin, then the fluid may be pressurized to a second threshold value, different from the first threshold value, to actuate the second firing pin.

Actuation of the firing pins then detonates a respective donor charge in step 206. For example, the firing system may include a first donor charge and a second donor charge. Thus, actuation of the firing pin may detonate the first donor charge, the second donor charge, or both. Further, if multiple firing pins are included, then actuation of a first firing pin detonates the first donor charge and actuation of a second firing pin detonates the second donor charge. Further, in some instances, actuation of a firing pin may fail to detonate a respective donor charge. Thus, only one of the first donor charge or second donor charge may detonate in response to actuation of the first and second firing pins.

Detonation of the first donor charge or the second donor charge produces a detonation wave (e.g., a shockwave). For example, detonation of the first donor charge produces a first detonation wave and detonation of the second donor charge produces a second detonation wave. The detonation wave travels in a direction of detonation toward an acceptor charge barrier. Upon reaching the acceptor charge barrier, the detonation wave propagates through the acceptor charge barrier in step 208.

As the detonation wave propagates through the acceptor charge barrier, the detonation wave travels into an acceptor charge, which detonates the acceptor charge in step 210. In some instances, a detonation wave produced by one of the first donor charge or the second donor charge may be insufficient to detonate the acceptor charge. In such instances, a detonation wave produced by the other of the first donor charge or the second donor charge detonates the acceptor charge. Further, even in instances in which a detonation wave produced by one of the first donor charge or second donor charge is sufficient to detonate the acceptor charge, the other of the first donor charge or second donor charge may still be detonated. Further, as described above, the acceptor charge may include a lower density zone proximate to the acceptor charge barrier to increase the sensitivity of the acceptor charge to the detonation wave.

The present disclosure may be used to create a firing system that detonates a charge in a downhole tool for use in a wellbore. This may include detonating a charge in a perforation gun for perforating the wellbore. This may enhance the reliability of detonating a charge in the wellbore, which may also increase the efficiency of the charge, decrease time spent on a downhole operation, decrease costs associated with a downhole operation, and/or increase certainty that the operation has been successfully completed.

Further examples may include:

Example 1 is a system for initiating a charge downhole in a wellbore, comprising a first donor charge detonable to produce a first detonation wave, a second donor charge detonable to produce a second detonation wave, and an acceptor charge detonable by either the first detonation wave or the second detonation wave. The system also comprises a donor charge barrier separating the first donor charge from the second donor charge. The donor charge barrier comprises heat dissipative and conduction characteristics for preventing deflagration from spreading between the first donor charge and the second donor charge. The system also comprises an acceptor charge barrier separating the acceptor charge from the first donor charge and the second donor charge. The acceptor charge barrier comprises shockwave impedance characteristics for conveying the first detonation wave or the second detonation wave to the acceptor charge to detonate the acceptor charge.

In Example 2, the subject matter of Example 1 can further include wherein the charge is part of a perforating gun.

In Example 3, the subject matter of Examples 1-2 can further include wherein the acceptor charge barrier comprises a material that is different from a material of the donor charge barrier.

In Example 4, the subject matter of Examples 1-3 can further include wherein the donor charge barrier comprises a material such that the first detonation wave is dampened through the donor charge barrier to the second donor charge and the second detonation wave is dampened through the donor charge barrier to the first donor charge.

In Example 5, the subject matter of Examples 1-4 can further include a perforating gun comprising a tubing string comprising a fluid-tight interior and a first firing pin within the interior, wherein the first firing pin is initiatable to detonate the first donor charge by pressurizing a fluid within the interior to a threshold pressure. The perforating gun also comprises a mechanical initiator movable to initiate a second firing pin to detonate the second donor charge.

In Example 6, the subject matter of Examples 1-5 can further include an explosive container surrounding at least a portion of longitudinal sides of the first donor charge, the second donor charge, and the acceptor charge.

In Example 7, the subject matter of Examples 1-6 can further include wherein the explosive container comprises brass.

In Example 8, the subject matter of Examples 1-7 can further include wherein the acceptor charge comprises a lower density zone located adjacent to the acceptor barrier, and a higher density zone located away from the acceptor barrier, wherein the lower density zone detonates at a lower threshold pressure than the higher density zone.

In Example 9, the subject matter of Examples 1-8 can further include wherein the lower density zone is 10 percent to 20 percent less dense than the higher density zone.

Example 10 is a method of firing a perforating gun downhole within a wellbore, comprising detonating a first donor charge to produce a first detonation wave. The first donor charge and a second donor charge are separated by a donor charge barrier that comprises heat dissipative and conduction characteristics for preventing deflagration from spreading between the first donor charge and the second donor charge. The method also comprises propagating the first detonation wave through an acceptor charge barrier. The acceptor charge barrier comprises heat dissipative and conduction characteristics for preventing deflagration from spreading from the first donor charge to the second donor charge. Further, the method comprises detonating the acceptor charge with the detonation wave, if sufficient, or detonating the second donor charge to produce a second detonation wave, propagating the second detonation wave through the acceptor charge barrier, and detonating the acceptor charge with the detonation wave.

In Example 11, the subject matter of Example 10 can further include wherein the detonation wave propagates through the acceptor charge barrier without puncturing the acceptor charge barrier.

In Example 12, the subject matter of Examples 10-11 can further include detonating the first donor charge before detonating the second donor charge.

In Example 13, the subject matter of Examples 10-12 can further include pressurizing a fluid within a tubing string from a surface of the wellbore; releasing a firing pin when the fluid reaches a threshold pressure to detonate the first donor charge, or the second donor charge; and initiating perforating charges in response to the detonation of the acceptor charge to perforate a production formation.

In Example 14, the subject matter of Examples 10-13 can further include wherein detonating the acceptor charge comprises detonating a lower density zone of the acceptor charge before detonating a higher density zone of the acceptor charge.

In Example 15, the subject matter of Examples 10-14 can further include directing the detonation wave within an explosive container surrounding at least a portion of longitudinal sides of the first donor charge, the second donor charge, and the acceptor charge.

Example 16 is a firing head for initiating a perforating gun downhole in a wellbore, comprising a donor charge detonable to produce a donor detonation wave and an acceptor charge detonable by the donor detonation wave to produce an acceptor detonation wave conveyable to the perforating gun. The firing head also comprises an acceptor charge barrier located between the acceptor charge and the donor charge. The acceptor charge barrier comprises heat dissipative and conduction characteristics for preventing deflagration from spreading between the donor charge and the acceptor charge.

In Example 17, the subject matter of Example 16 can further include wherein the acceptor charge barrier comprises stainless steel.

In Example 18, the subject matter of Examples 16-17 can further include an explosive container surrounding the first donor charge, the second donor charge, and the acceptor charge.

In Example 19, the subject matter of Examples 16-18 can further include wherein the acceptor charge comprises a lower density zone located next to the acceptor barrier and a higher density zone located away from the acceptor barrier, wherein the lower density zone detonates at a lower threshold pressure than the higher density zone.

In Example 20, the subject matter of Examples 16-19 can further include wherein the firing head is attachable at a location within a tubing string that is longitudinally above the perforating gun, or longitudinally below the perforating gun.

One or more specific embodiments of the system and method for firing a charge in a well tool have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A system for initiating a charge downhole in a wellbore, comprising:

a first donor charge detonable to produce a first detonation wave;

a second donor charge detonable to produce a second detonation wave;

an acceptor charge detonable by either the first detonation wave or the second detonation wave;

a donor charge barrier separating the first donor charge from the second donor charge, wherein the donor charge barrier comprises heat dissipative and conduction characteristics for preventing deflagration from spreading between the first donor charge and the second donor charge; and an acceptor charge barrier separating the acceptor charge from the first donor charge and the second donor charge, wherein the acceptor charge barrier comprises shockwave impedance characteristics for conveying the first detonation wave or the second detonation wave to the acceptor charge to detonate the acceptor charge.

2. The system of claim 1, wherein the charge is part of a perforating gun.

3. The system of claim 1, wherein the acceptor charge barrier comprises a material that is different from a material of the donor charge barrier.

4. The system of claim 1, wherein the donor charge barrier comprises a material such that the first detonation wave is dampened through the donor charge barrier to the second donor charge and the second detonation wave is dampened through the donor charge barrier to the first donor charge.

5. The system of claim 1, comprising a perforating gun comprising, a tubing string comprising a fluid-tight interior and a first firing pin within the interior, wherein the first firing pin is initiatable to detonate the first donor charge by pressurizing a fluid within the interior to a threshold pressure; and a second firing pin initiatable to detonate the second donor charge.

6. The system of claim 1, comprising an explosive container surrounding at least a portion of longitudinal sides of the first donor charge, the second donor charge, and the acceptor charge.

7. The system of claim 6, wherein the explosive container comprises brass.

8. The system of claim 1, wherein the acceptor charge comprises a lower density zone located adjacent to the acceptor barrier, and a higher density zone located away from the acceptor barrier, wherein the lower density zone detonates at a lower threshold pressure than the higher density zone.

9. The system of claim 8, wherein the lower density zone is 10 percent to 20 percent less dense than the higher density zone.

10. A method of firing a perforating gun downhole within a wellbore comprising:

detonating a first donor charge to produce a first detonation wave, wherein the first donor charge and a second donor charge are separated by a donor charge barrier that comprises heat dissipative and conduction characteristics for preventing deflagration from spreading between the first donor charge and the second donor charge;

propagating the first detonation wave through an acceptor charge barrier, wherein the acceptor charge barrier comprises shockwave impedance characteristics for conveying the first detonation wave to the acceptor charge; and detonating the acceptor charge with the detonation wave, if sufficient, or detonating the second donor charge to produce a second detonation wave, propagating the second detonation wave through the acceptor charge barrier, and detonating the acceptor charge with the detonation wave.

11. The method of claim 10, wherein the detonation wave propagates through the acceptor charge barrier without puncturing the acceptor charge barrier.

12. The method of claim 10, comprising detonating the first donor charge before detonating the second donor charge.

13. The method of claim 10, comprising:

pressurizing a fluid within a tubing string from a surface of the wellbore;

releasing a firing pin when the fluid reaches a threshold pressure to detonate the first donor charge, or the second donor charge; and initiating perforating charges in response to the detonation of the acceptor charge to perforate a production formation.

14. The method of claim 10, wherein detonating the acceptor charge comprises detonating a lower density zone of the acceptor charge before detonating a higher density zone of the acceptor charge.

15. The method of claim 10, comprising directing the detonation wave within an explosive container surrounding at least a portion of longitudinal sides of the first donor charge, the second donor charge, and the acceptor charge.

16. A firing head for initiating a perforating gun downhole in a wellbore, comprising:

a first donor charge detonable to produce a donor detonation wave;

an acceptor charge detonable by the donor detonation wave to produce an acceptor detonation wave conveyable to the perforating gun;

an acceptor charge barrier located between the acceptor charge and the donor charge, wherein the acceptor charge barrier comprises heat dissipative and conduction characteristics for preventing deflagration from spreading between the donor charge and the acceptor charge.

17. The firing head of claim 16, wherein the acceptor charge barrier comprises stainless steel.

18. The firing head of claim 16, further comprising:

a second donor charge detonable to produce a second detonation wave; and an explosive container surrounding the first donor charge, the second donor charge, and the acceptor charge.

19. The firing head of claim 16, wherein the acceptor charge comprises a lower density zone located next to the acceptor barrier and a higher density zone located away from the acceptor barrier, wherein the lower density zone detonates at a lower threshold pressure than the higher density zone.

20. The firing head of claim 16, wherein the firing head is attachable at a location within a tubing string that is longitudinally above the perforating gun, or longitudinally below the perforating gun.

* * * * *